US011091827B2

(12) United States Patent
Park et al.

(10) Patent No.: US 11,091,827 B2
(45) Date of Patent: Aug. 17, 2021

(54) COPPER ALLOY MATERIAL FOR AUTOMOBILE AND ELECTRICAL AND ELECTRONIC COMPONENTS AND METHOD OF PRODUCING THE SAME

(71) Applicant: POONGSAN CORPORATION, Pyeongtaek-si (KR)

(72) Inventors: Cheol Min Park, Daejeon (KR); Hyo Moon Nam, Ulsan (KR); Jun Hyung Kim, Ulsan (KR)

(73) Assignee: POONGSAN CORPORATION, Pyeongtaek-si (KR)

( * ) Notice: Subject to any disclaimer, the term of this patent is extended or adjusted under 35 U.S.C. 154(b) by 492 days.

(21) Appl. No.: 16/066,642

(22) PCT Filed: Jul. 22, 2016

(86) PCT No.: PCT/KR2016/008028
§ 371 (c)(1),
(2) Date: Jun. 27, 2018

(87) PCT Pub. No.: WO2017/115963
PCT Pub. Date: Jul. 6, 2017

(65) Prior Publication Data

US 2019/0010593 A1 Jan. 10, 2019

(30) Foreign Application Priority Data

Dec. 28, 2015 (KR) ..... 10-2015-0187790

(51) Int. Cl.
*C22F 1/08* (2006.01)
*C22C 9/06* (2006.01)

(52) U.S. Cl.
CPC . *C22F 1/08* (2013.01); *C22C 9/06* (2013.01)

(58) Field of Classification Search
CPC ..... C22F 1/08; C22C 9/00; C22C 9/06; C22C 9/10
See application file for complete search history.

(56) References Cited

U.S. PATENT DOCUMENTS 8,784,580 B2 * 7/2014 Fugono ..... C22C 9/06 148/435
2011/0223056 A1 9/2011 Aruga et al.
2014/0302342 A1 10/2014 Aoyama et al.

FOREIGN PATENT DOCUMENTS

| | | | |
|---|---|---|---|
| CN | 101743333 | A | 6/2010 |
| CN | 102453815 | A | 5/2012 |
| CN | 108602097 | B | 2/2020 |
| JP | 02-197013 | A2 | 8/1990 |
| JP | 03188247 | A * | 8/1991 |
| JP | H03-188247 | A | 8/1991 |
| JP | 2000-249789 | A2 | 9/2000 |

(Continued)

OTHER PUBLICATIONS

PH Office Action in Application No. 1-2018-501391 dated Oct. 19, 2020.

(Continued)

*Primary Examiner* — John A Hevey
(74) *Attorney, Agent, or Firm* — Maschoff Brennan

(57) ABSTRACT

A method of producing a copper alloy material for automobile and electrical and electronic components. The copper alloy material produced by the method exhibits superior tensile strength, spring limit, electrical conductivity and bendability.

8 Claims, 4 Drawing Sheets

(56) References Cited

FOREIGN PATENT DOCUMENTS

| | | | |
|---|---|---|---|
| JP | 3798260 | B2 | 4/2006 |
| JP | 2006-283059 | A | 10/2006 |
| JP | 2007-070651 | A | 3/2007 |
| JP | 2008-196042 | A | 8/2008 |
| JP | 04566048 | B2 | 10/2010 |
| JP | 2011-017072 | A | 1/2011 |
| JP | 2011-052316 | A | 3/2011 |
| JP | 2011-162848 | A | 8/2011 |
| JP | 2011-214087 | A | 10/2011 |
| JP | 2012-246549 | A | 12/2012 |
| JP | 2013-163853 | A | 8/2013 |
| JP | 2013-235796 | B2 | 11/2013 |
| JP | 2015-048519 | A | 3/2015 |
| JP | 2016-047945 | A | 4/2016 |
| KR | 10-1208578 | B1 | 8/2010 |
| KR | 2010-0092096 | A | 8/2010 |
| KR | 10-2014-0053376 | A | 5/2014 |
| KR | 101627696 | B1 | 6/2016 |

OTHER PUBLICATIONS

CN Office Action (App. No. 201680076669.6) dated Mar. 22, 2019.
Feldman et al., Rolling Models: Adaptive Setup Models for Cold Rolling Mills, ABB Review, Jan. 2009.

* cited by examiner

[Fig. 1A]
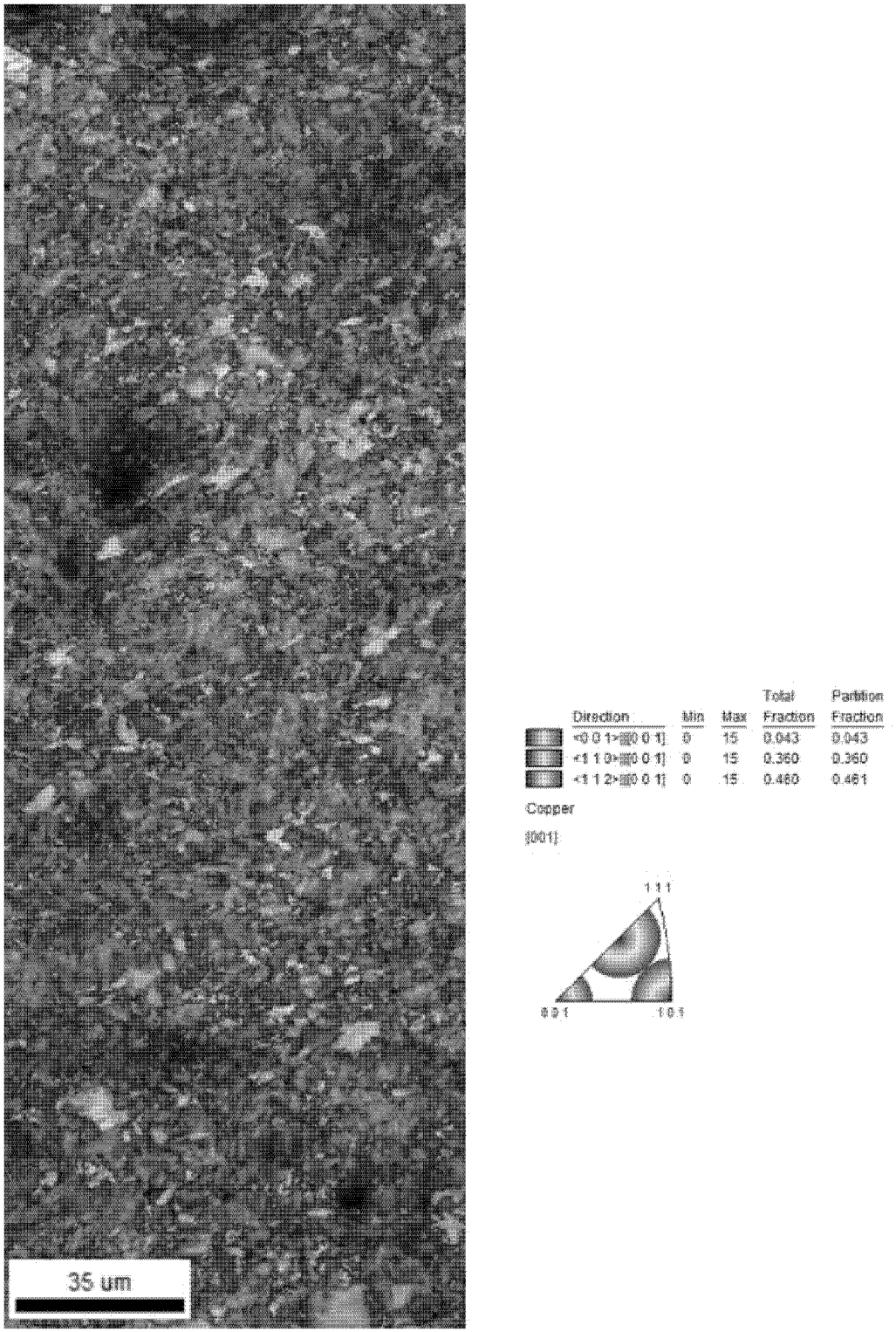

[Fig. 1B]
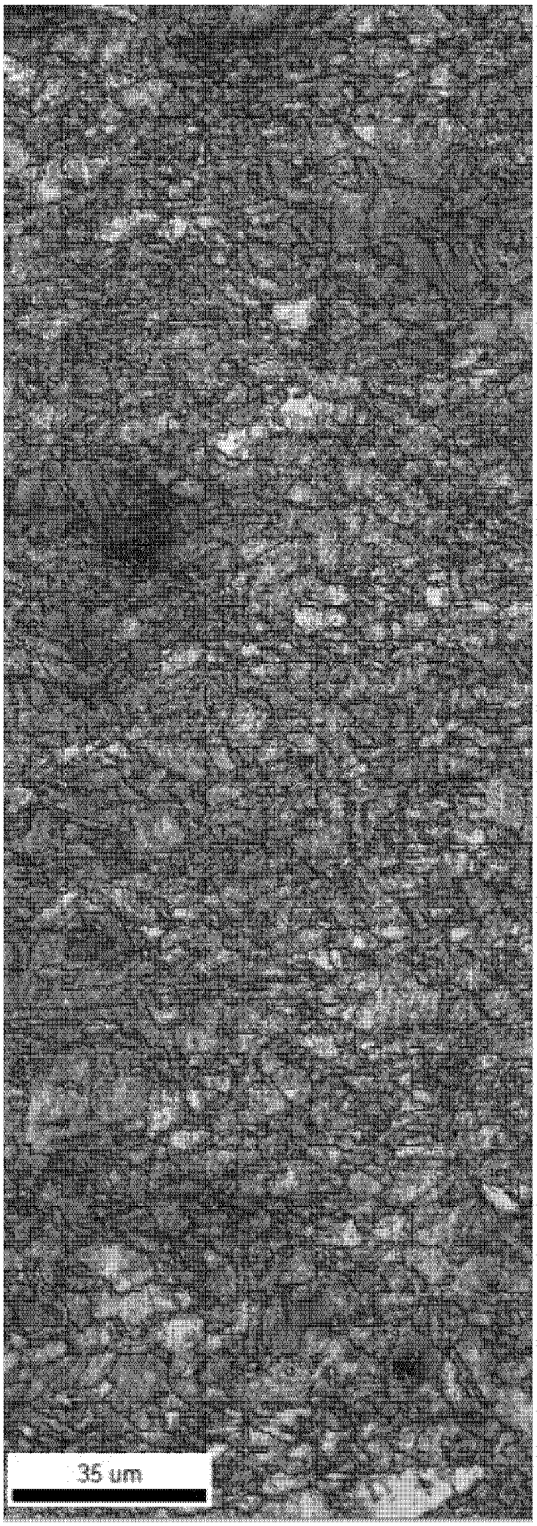
Boundaries: Rotation Angle
| | Min | Max | Fraction | Number | Length |
|---|---|---|---|---|---|
| | 2 | 5 | 0.542 | 125080 | 3.61 cm |
| | 5 | 15 | 0.112 | 25747 | 7.43 mm |
| | 15 | 180 | 0.347 | 80075 | 2.31 cm |

[Fig. 2A]
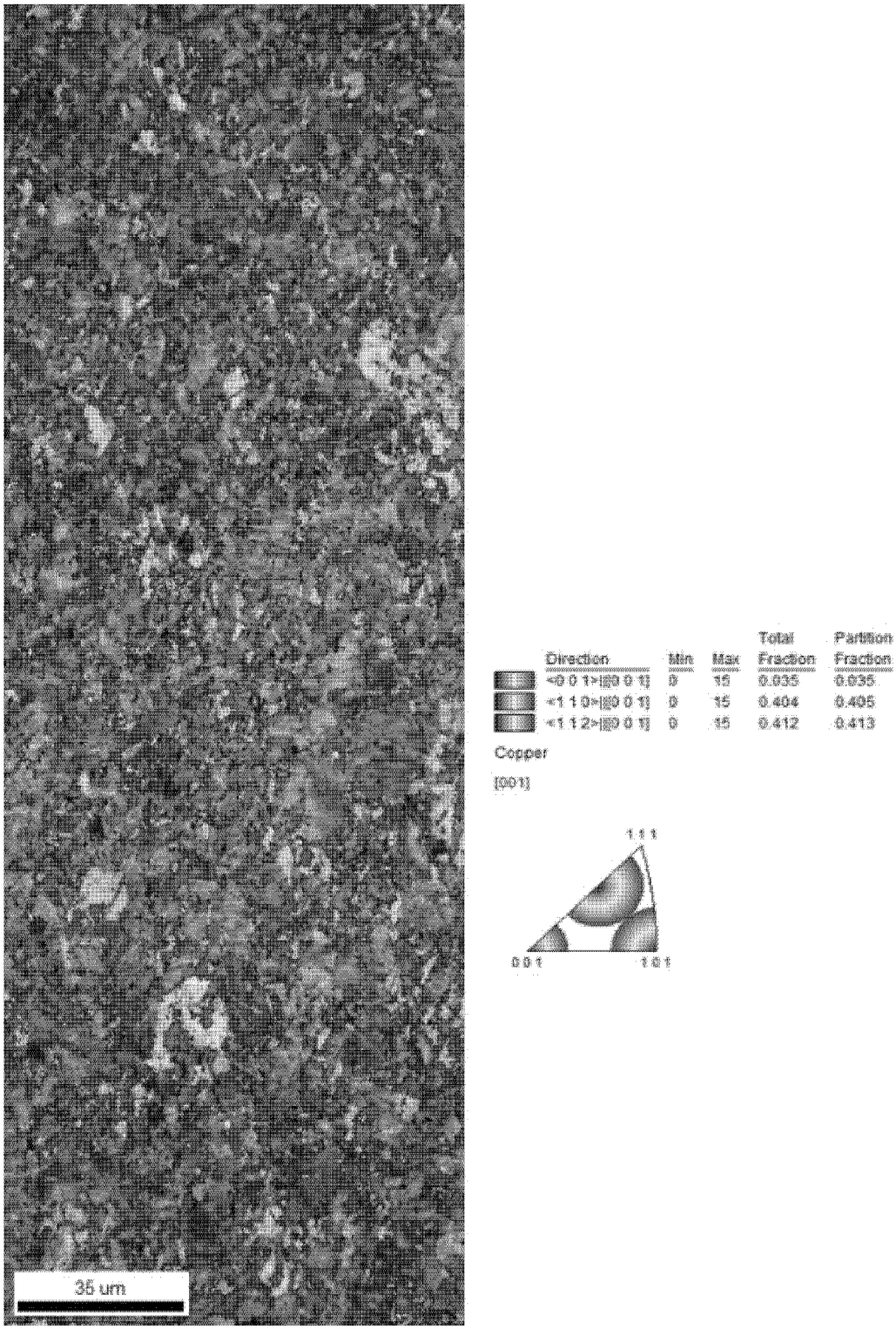

[Fig. 2B]
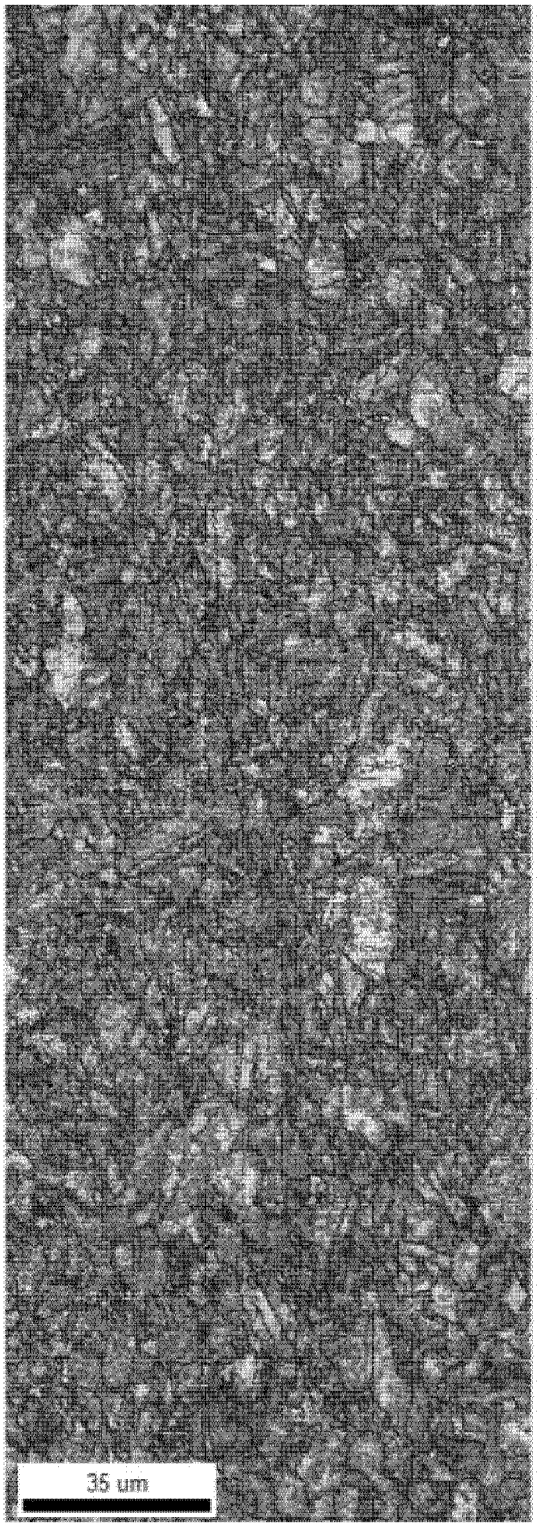
Boundaries: Rotation Angle
| | Min | Max | Fraction | Number | Length |
|---|---|---|---|---|---|
| | 2 | 5 | 0.531 | 115813 | 3.34 cm |
| | 5 | 15 | 0.112 | 24378 | 7.04 mm |
| | 15 | 180 | 0.357 | 77971 | 2.25 cm |

COPPER ALLOY MATERIAL FOR AUTOMOBILE AND ELECTRICAL AND ELECTRONIC COMPONENTS AND METHOD OF PRODUCING THE SAME

TECHNICAL FIELD

The present invention relates to a copper alloy material for automobile and electrical and electronic components and a method of producing the same, and more particularly, to a copper alloy material having superior tensile strength, spring limit, electrical conductivity and bendability as a small and precision connector, a spring material, a semiconductor leadframe, an automobile and electrical and electronic connector, and an information transfer or direct electrical material such as a relay material, and a method of producing the same.

BACKGROUND ART

A variety of copper alloy materials for automobile and electrical and electronic components, which are suitable for different requirements for applications such as connectors, terminals, switches, relays and lead frames, are used. However, in accordance with multi-functionalization of automobile and electrical and electronic components and complicated configuration of electrical circuits, the corresponding components need small size and low weight. In order to satisfy this necessity, there is a need for improvement in characteristics of copper alloy materials used as materials for the components.

For example, connectors for automobiles are classified into 0.025 inches, 0.050 inches, 0.070 inches, 0.090 inches and 0.250 inches connectors depending on width thereof, and are called "025, 050, 070, 090 and 250 connectors" depending on thickness of connectors. The size of connectors is gradually decreasing. In addition, the number of pins of connector terminals is increased to 100 or more, as compared to 50 to 70 in the prior art.

In accordance with size reduction and density increase of the connectors, the width of copper alloy materials is gradually decreasing to 0.30 mm, 0.25 mm and 0.15 mm from 0.4 mm in the prior art. The width reduction of copper alloy materials causes bending phenomenon of pin parts during terminal work to a thickness of 0.15 mm at typical levels of tensile strength and spring limit (about tensile strength of 610 MPa and spring limit of 450 MPa) of copper alloy materials. Accordingly, to prevent the bending phenomenon, copper alloy materials used for automobile and electrical and electronic components need to have improved strength, more specifically, a tensile strength of 620 MPa or higher, and a spring limit of 460 MPa or higher.

Meanwhile, during terminal work of automobile and electrical and electronic components, bending work is applied in a rolling direction (or direction parallel to rolling) as well as in a direction vertical to rolling. Accordingly, there is an urgent demand for improvement in bendability both in the rolling direction and in the direction vertical to rolling.

Copper alloy materials produced in a solid solution strengthened form based on addition of alloy elements, such as phosphor bronze or brass, are generally used as common automobile and electrical and electronic components, but solid solution strengthened copper alloy materials exhibit superior strength to general pure copper, but have a drawback of lower electrical conductivity as compared to pure copper. In addition, phosphor bronze has good bendability in a direction vertical to rolling, whereas it cracks during bending work in a rolling direction. In addition, brass and phosphor bronze may cause short, such as contact short due to material softening even application to heated parts, for example, terminals near automobile engines and use thereof is thus strictly restricted.

In addition, copper alloys commonly used for automobile and electrical and electronic components are corson based copper alloys (Cu—Ni—Si based copper alloys) and exhibits a difference between bending work in a rolling direction and a direction vertical to rolling due to worked textures formed during rolling in the production step by rolling after precipitation heat treatment in order to improve strength. In addition, as described above, levels of required tensile strength and spring limit are increased in accordance with size reduction and density increase of copper alloy materials for automobile and electrical and electronic components, but tensile strength and spring limit of conventional corson based copper alloys (Cu—Ni—Si based copper alloys) do not satisfy these levels and thus disadvantageously cause a bending phenomenon.

In summary, copper alloy materials commonly used for automobile or electrical and electronic components need bendability in a rolling direction and a direction vertical to rolling as well as high tensile strength, high spring limit and high electrical conductivity, which are required in accordance with size reduction and density increase of components. However, because, in general, tensile strength and spring limit are in inversely proportional to bendability, there is a considerably high demand for development of copper alloy materials having all of the aforementioned properties. In particular, research is actively underway on Cu—Ni—Si alloys which satisfy bendability in a rolling direction and in a direction vertical to rolling while retaining high tensile strength and high spring limit.

Japanese Patent Laid-open Publication No. 2006-283059 discloses improvement in bendability by controlling crystal orientation such that an area proportion of {001}<100> plane having a cubic crystal orientation reaches 50% or higher and Japanese Patent Laid-open Publication No. 2011-017072 discloses improvement in bendability by adjusting an area proportion of a brass crystal orientation {110}<112>, an area proportion of a copper crystal orientation {121}<111> and an area proportion of a cubic crystal orientation {001}<100> to 20% or less, 20% or less, and 5 to 60%, respectively.

That is, as described above, in the prior art, in an attempt to improve bendability, an area proportion of cubic crystal orientation {001}<100> was increased by controlling conventional crystal orientations. However, because cubic crystal orientation of Cu—Ni—Si copper alloys is grown during thermal treatment, tensile strength and spring limit of Cu—Ni—Si copper alloys are disadvantageously deteriorated, as the area proportion of cubic crystal orientation {001}<100> increases.

DISCLOSURE OF INVENTION

Technical Problem

An object of the present invention devised to solve the problem lies on a method of producing a copper alloy material for automobile and electrical and electronic components which has superior tensile strength, spring limit, electrical conductivity and bendability.

Solution to Problem

The object of the present invention can be achieved by providing a method of producing a copper alloy material for automobile and electrical and electronic components including (a) melting constituent components and casting an ingot from the constituent components, wherein the constituent components include 1.0 to 4.0 wt % of nickel (Ni), 0.1 to 1.0 wt % of silicon (Si), 0.1 to 1.0 wt % of tin (Sn), the balance of copper and an inevitable impurity, wherein the inevitable impurity includes one or more transition metals selected from the group consisting of Ti, Co, Fe, Mn, Cr, Nb, V, Zr and Hf and is present in a total amount of 1 wt % or less, (b) subjecting the resulting ingot to hot-rolling at a temperature of 750 to 1,000° C. for 1 to 5 hours, (c) subjecting the resulting product to intermediate cold rolling at a rolling reduction of 50% or higher, (d) subjecting the resulting product to high-temperature high-speed solution heat treatment at 780 to 1,000° C. for 1 to 300 seconds, (e) subjecting the resulting product to final cold rolling at a rolling reduction of 10 to 60% ten times or less, (f) subjecting the product obtained by the previous step to precipitation heat treatment at 400 to 600° C. for 1 to 20 hours, and (g) subjecting the precipitation-treated product to stress relief treatment at 300 to 700° C. for 10 to 3,000 seconds, wherein, as a result of EBSD analysis, the obtained copper alloy material has a {001} crystal plane fraction of 10% or less, a {110} crystal plane fraction of 30 to 60%, a {112} crystal plane fraction of 30 to 60%, a low angle grain boundary fraction of 50 to 70%, tensile strength of 620 to 1,000 MPa, spring limit of 460 to 750 MPa, electrical conductivity of 35 to 50% IACS, and superior bendability in a rolling direction and a direction vertical to the rolling direction.

(c) Intermediate rolling and (d) solution heat treatment may be repeatedly conducted, according to necessity.

In addition, the method may further include adjusting a plate shape, before or after (t) precipitation heat treatment.

Meanwhile, the method may further include plating tin (Sn), silver (Ag), or nickel (Ni) after (g) stress relief. In addition, the method may further include producing the copper alloy material obtained after (g) stress relief in the form of a plate, rod or tube.

1.0 wt % or less of phosphorous (P) may be further added. 1.0 wt % or less of zinc (Zn) may be further added. 1.0 wt % or less of phosphorous (P) and 1.0 wt % or less of zinc (Zn) may be further added.

In accordance with another aspect of the present invention, provided herein is a copper alloy material for automobile and electrical and electronic components produced by the method as described above.

Advantageous Effects of Invention

The present invention provides a method of producing a copper alloy material for automobile and electrical and electronic components which exhibits superior tensile strength, spring limit, electrical conductivity and bendability.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1A illustrates a crystal plane fraction of a sample (Cu-1.8Ni-0.3Si-0.3Sn-0.01P) according to Example 1;

FIG. 1B illustrates a grain boundary fraction of a sample (Cu-1.8Ni-0.3Si-0.3Sn-0.01P) according to Example 1;

FIG. 2A illustrates a crystal plane fraction of a sample (Cu-2.2Ni-0.5Si-0.3Sn-0.01P-0.1Zn) according to Example 4; and FIG. 2B illustrates a grain boundary fraction of a sample (Cu-2.2Ni-0.5Si-0.3Sn-0.01P-0.1Zn) according to Example 4.

BEST MODE FOR CARRYING OUT THE INVENTION

Reference will now be made in detail to the preferred embodiments of the present invention, examples of which are illustrated in the accompanying drawings.

Chemical components of the copper alloy material for automobile and electrical and electronic components according to the present invention will be described. The copper alloy material according to the present invention includes 1.0 to 4.0 wt % of nickel (Ni), 0.1 to 1.0 wt % of silicon (Si), 0.1 to 1.0 wt % of tin (Sn), the balance of copper (Cu) and an inevitable impurity, wherein the inevitable impurity includes one or more transition metals selected from the group consisting of Ti, Co, Fe, Mn, Cr, Nb, V, Zr and Hf.

The copper alloy material may further include one or more of 1.0 wt % or less of phosphorous (P) and 1.0 wt % or less of zinc (Zn), if necessary. The sum of the components is 2 wt % or less.

Functions and content ranges of constituent elements contained in the copper alloy material according to the present invention will be described below.

(1) Ni and Si

Regarding the copper alloy material according to the present invention, the content of Ni is 1.0 to 4.0 wt % and the content of Si is 0.1 to 1.0 wt %. When the weight of Ni is less than 1.0 wt % and the weight of Si is less than 0.1 wt %, sufficient strength cannot be obtained by precipitation heat treatment and the copper alloy material is unsuitable for application to automobile, electrical and electronic connectors, semiconductors and leadframes. In addition, when the content of Ni exceeds 4 wt % and the content of Si exceeds 1.0 wt %, Ni—Si crystals formed during casting are rapidly grown to coarse compounds during heating prior to hot rolling, thus causing side cracking during hot rolling.

(2) Sn

Sn is an element which slowly diffuses in the Cu matrix, and inhibits growth of Ni—Si precipitates during precipitation heat treatment and finely distributes the Ni—Si precipitates to improve strength. Regarding the copper alloy material according to the present invention, Sn is present in an amount of 0.1 wt % to 1.0 wt %. When Sn is present in an amount of 0.1 wt % or less, Sn cannot exert an effect of distributing Ni—Si precipitates, thus deteriorating tensile strength and spring limit and, when Sn is present in an amount exceeding 1.0 wt %, Sn is present in the Cu matrix even after precipitation, thus rapidly deteriorating electrical conductivity.

(3) P

The copper alloy material according to the present invention may further include 1.0 wt % or less of phosphorous (P). When phosphorous (P) is further included, the content of copper is decreased corresponding to the content of phosphorous (P). Phosphorous (P) serves as a deoxidizer during molten metal dissolution in the production of the copper alloy material according to the present invention and creates various forms of precipitates such as $Ni_3P$, $Ni_5P_2$, $Fe_3P$, $Mg_3P_2$, and $MgP_4$ during precipitation heat treatment. In particular, phosphorous (P) serves as a mediator for combining one or more of transition metals, such as Co, Fe, Mn, Cr, Nb, V, Zr and Hf, present in the copper alloy material, with Ni—Si precipitates. Accordingly, phosphorous (P) separates other impurities in the copper matrix structure to form a precipitate such as Cu—Ni—Si—P—X (wherein X includes one or more transition metals of Co, Fe, Mn, Cr, Nb, V, Zr, and Hf), thereby advantageously improving tensile strength and electrical conductivity. When the content of phosphorous in the copper alloy material according to the present invention is higher than 1.0 wt %, the electrical conductivity of the copper alloy material is excessively deteriorated.

(4) Zn

The copper alloy material according to the present invention may further include 1.0 wt % or less of Zn. The balance of Cu is decreased corresponding to the amount of added Zn. Regarding the copper alloy material according to the present invention, Zn improves heat detachment resistance of Sn plating or solder during plating of copper alloy plates and inhibits heat detachment of the plating layer. When Zn is present in the copper alloy material according to the present invention, the content of Zn is 1.0 wt % or less. When the content of Zn exceeds 1.0 wt %, electrical conductivity of the copper alloy material is greatly deteriorated.

(5) Impurities (Ti, Co, Fe, Mn, Cr, Nb, V, Zr, Hf)

The impurities according to the present invention mean one or more transition metals selected from the group consisting of Ti, Co, Fe, Mn, Cr, Nb, V, Zr, and Hf. The impurities form an intermetallic compound with NiSi using a P component as a mediator during precipitation heat treatment and the intermetallic compound is precipitated in the matrix, thus increasing strength. However, when the total amount of impurities exceeds 1 wt %, impurities still remain in the Cu matrix even after precipitation heat treatment, thus causing significant deterioration in electrical conductivity.

The method of producing the copper alloy material according to the present invention will be described below.

(a) Ingot Casting

An ingot is cast from constituent components of the copper alloy material for automobile and electrical and electronic components according to the present invention. The ingot includes 1.0 to 4.0 wt % of nickel (Ni), 0.1 to 1.0 wt % of silicon (Si), 0.1 to 1.0 wt % of tin (Sn), the balance of copper (Cu) and an inevitable impurity. Optionally, the ingot may include 1 wt % or less of one or more of phosphorous (P) and zinc (Zn). When the optional constituent element is present, the content of copper is controlled depending on the amount of added optional constituent element. In addition, as other impurity, one or more transition metals selected from the group consisting of Ti, Co, Fe, Mn, Cr, Nb, V, Zr and Hf may be present in the total amount of 1 wt % or less and the other impurity is inevitably contained via scraps, electrical copper and copper scraps.

(b) Hot Rolling

The ingot product obtained in the previous step is preferably hot rolled at a temperature of 750° C.° to 1,000° C. for 1 to 5 hours, more preferably, at 900° C. to 1,000° C. for 2 to 4 hours. When hot rolling is carried out at a temperature of 750° C. or less for a time shorter than 1 hour, the ingot structure remains in the obtained product, thus causing deterioration in strength and bendability. In addition, when hot rolling is carried at a temperature higher than 1,000° C. for a time longer than 5 hours, crystal grains in the obtained copper alloy become coarse, thus causing deterioration in bendability of components produced with a desired thickness.

(c) Intermediate Cold Rolling

The product obtained in the previous hot rolling step is subjected to intermediate cold rolling at room temperature. Rolling reduction of intermediate cold rolling is preferably 50% or higher, more preferably, 80% or higher. When the rolling reduction of intermediate cold rolling is lower than 50%, sufficient dislocation is not generated in the Cu matrix, re-crystallization is delayed during the subsequent solution heat treatment, sufficient over-saturated state is not formed and sufficient tensile strength cannot be thus obtained.

(d) High-Temperature High-Speed Solution Heat Treatment

Solution heat treatment is the most essential step to secure high tensile strength, high spring limit and superior bendability of the finally obtained copper alloy material. Solution heat treatment is preferably carried out at a temperature of 780 to 1,000° C. for 1 to 300 seconds, more preferably, at 950 to 1,000° C. for 10 to 60 seconds. The copper alloy material according to the present invention finally obtained after solution heat treatment has improved tensile strength and spring limit while maintaining bendability.

When the solution heat treatment temperature is lower than 780° C., or solution heat treatment time is shorter than 1 second, sufficient over-saturated state cannot be formed, sufficient NiSi precipitates are not obtained even after precipitation heat treatment, and tensile strength and spring limit are thus deteriorated, and when the solution heat treatment temperature is higher than 1,000° C., or solution heat treatment time is longer than 300 seconds, excessive NiSi precipitates are formed and bendability is thus deteriorated.

Meanwhile, variation of physical properties of the finished product associated with conditions of the solution heat treatment can be analyzed by measuring Vickers hardness and crystal grain particle size of the final product as a sample. In accordance with conditions of the solution heat treatment, the hardness (Vickers hardness, 1 to 5 kgf) of the finally obtained copper alloy material ranges from 75 to 95 Hv, more preferably from 80 to 90 Hv, and the mean particle size of crystal grains in the copper alloy material ranges from 3 to 20 μm, more preferably from 5 to 15 μm.

In addition, as described above, when high-speed solution heat treatment is conducted at a high temperature, growth of {001} crystal plane formed during solution heat treatment is inhibited and, regarding a fraction of low angle grain boundary formed during intermediate cold rolling before solution heat treatment, because crystal grains are rearranged by solution heat treatment, as a result of analysis of EBSD, {001} crystal plane in the copper alloy material is controlled to 5% or less and a fraction of low angle crystal grains is controlled to below 10%. That is, when solution heat treatment temperature is lower than 780° C. or solution heat treatment time is 1 second or shorter, the hardness of the finally obtained copper alloy material is 95 Hv or higher, the particle size of crystal grains is 3 μm or less, and tensile strength and spring limit are deteriorated and, when solution heat treatment temperature is 1,000° C. or higher or solution heat treatment time is 300 seconds or longer, the hardness of the finally obtained copper alloy material is decreased to 75 Hv or less, crystal grains are grown to a size of 20 μm or more, and bendability is deteriorated. In particular, bendability in a rolling direction (or referred to as a direction parallel to rolling) is rapidly deteriorated.

(e) Final Cold Rolling

The product obtained after the solution heat treatment is subjected to final cold rolling. The rolling reduction of the final cold rolling ranges from 10 to 60%, preferably, from 20 to 40%. EBSD analysis result of the final cold rolled product shows that about 50 to 80% of low angle grain boundary is formed within the range defined above. When the rolling reduction of final cold rolling is less than 10%, {110} crystal plane and {112} crystal plane are not sufficiently formed and tensile strength is significantly deteriorated. When the final rolling reduction exceeds 60%, {110} crystal plane and {112} crystal plane are rapidly formed, low angle grain boundary fraction is degraded and bendability is deteriorated. In addition, the number of cold rolling (also, referred to as the number of "passes") is preferably 7 (the number of passes) or less, more preferably, 4. When the number of rolling exceeds 10, initial dislocations are annihilated due to decreased work curing capability, and tensile strength and spring limit are deteriorated after final aging.

(f) Precipitation Heat Treatment

The product obtained by the previous step is preferably subjected to precipitation heat treatment at 400 to 600° C. for 1 to 20 hours, more preferably, at 450 to 550° C. for 5 to 15 hours. Nuclei are formed and grown from fine Ni—Si precipitates present in the product obtained by the previous step during precipitation heat treatment and Ni—Si precipitates present on the grain boundary by final rolling work before precipitation heat treatment in the dislocation site in the Cu matrix. In this process, low diffusion speed of Sn element inhibits growth of Ni—Si precipitates and uniformly distributes the Ni—Si precipitates in the Cu matrix and grain boundary. As a result, tensile strength, electrical conductivity, spring limit and bendability of the finally obtained copper alloy material are improved.

When the precipitation heat treatment temperature is lower than 400° C., or precipitation heat treatment time is shorter than one hour, the amount of heat required for precipitation heat treatment is insufficient, nuclei cannot be sufficiently formed and grown from Ni—Si precipitates to Ni—Si precipitated compounds in the Cu matrix, and tensile strength, electrical conductivity and spring limit are thus deteriorated. In addition, dislocations formed during final rolling are further concentrated in a rolling direction, bendability in a bad way direction (direction parallel to rolling or rolling direction) during bending work is further deteriorated and anisotropy is formed during bending work. On the other hand, when the precipitation heat treatment temperature exceeds 600° C. or precipitation heat treatment time is 20 hours or longer, over-aging occurs and electrical conductivity of the obtained copper alloy material can be maximized, but tensile strength and spring limit of the final product are decreased.

(g) Stress Relief Treatment

The product obtained by the previous step is subjected to stress relief treatment at 300 to 700° C. for 10 to 3,000 seconds, more preferably at 500 to 600° C. for 15 to 300 seconds. The stress relief treatment is a process of reducing, by heating, stress, which is formed by variation in plasticity of the obtained product and in particular, and is important to restore the spring limit after adjustment of plate-shape.

When the stress relief treatment is carried out at a temperature lower than 300° C. for a time shorter than 10 seconds, loss of spring limit resulting from adjustment of plate shape cannot be sufficiently recovered and, when the stress relief treatment is carried out at a temperature higher than 700° C. for a time longer than 3,000 seconds, mechanical properties such as tensile strength and spring limit may be deteriorated because the ideal range for recovering maximum spring limit is not satisfied.

Meanwhile, regarding the method of producing the copper alloy material according to the present invention, in order to accomplish the desired thickness of the final product, (c) the intermediate cold rolling and (d) the solution heat treatment may be repeated, if necessary.

In addition, before or after (f) precipitation heat treatment, plate shape adjustment may be carried out according to the plate shape of the material.

In addition, after (g) stress relief, tin (Sn), silver (Ag) or nickel (Ni) plating may be carried out according to applications. In addition, the copper alloy material obtained after (g) stress relief may be produced into a plate, rod or tubular shape. During the process, the plating may be a post-production step and may thus be applied as the final process.

Meanwhile, crystal plane and low angle grain boundary fractions of the copper alloy material produced by the method of producing the copper alloy material according to the present invention have the following characteristics.

Measurement of Crystal Plane and Low Angle Grain Boundary

Regarding cracking of Cu—Ni—Si alloys during bending work, dislocations formed by deformation in the production step are formed according to share during bending work, thus causing deterioration in bendability. The formation of dislocations is concentrated at a high angle grain boundary among the grain boundaries. In the present invention, grain boundary fraction is analyzed in accordance with the following method and the fraction of low angle grain boundary is maximized to secure bendability.

Miller index and Euler angle of ideal orientations in Cu—Ni—Si alloys are represented by the following Table 1 (Document [Basic crystal textures of steel materials](see Heo, Moo Young, 2014).

TABLE 1

| Miller index | Euler angle | Crystal orientation |
|---|---|---|
| (000)[0-10] | (45, 0, 45) | Cube |
| (001)[1-10] | (0, 0, 45) | Rotated-Cube |
| (112)[1-10] | (0, 35, 45) | — |
| (111)[1-10] | (60, 55, 45) | {111}//ND |
| (111)[1-21] | (30, 55, 45) | {111}//ND |
| (110)[1-12] | (55, 90, 45) | Brass |
| (112)[−1-11] | (90, 35, 45) | Copper |
| (110)[001] | (90, 90, 45) | Goss |

As can be seen from Table 1, the {001} crystal plane in the copper alloy material includes a cubic crystal orientation and a rotated-cubic crystal orientation, and the {110} crystal plane includes a Brass crystal orientation and a Goss crystal orientation, and the {112} crystal plane includes a Copper crystal orientation.

In general, the cubic crystal orientation formed by the {001} crystal plane is related to bendability and is formed during thermal treatment of the production method according to the present invention, and the Brass crystal orientation and Goss crystal orientation formed by the {110} crystal plane, and copper orientation formed by the {112} crystal plane greatly function to improve tensile strength and spring limit in the production method of the present invention and is formed during rolling.

The sample is measured with EBSD (electron back scatter diffraction) analysis equipment, Euler angle and the like of the orientation g of coordinates (x,y) axes of the obtained measurement points are recorded and an EBSD orientation map is drawn using EBSD analysis software. Fractions of {001}, {110} and {112} crystal planes are calculated from the EBSD orientation measurement data. In this case, EBSD orientation map scatter angle is set to V=15 degrees.

Bendability is closely related to Cu matrix of fine textures, grain boundary and dislocation density. In particular, stress during bending work is intensely generated in the relatively weak grain boundary site, dislocation density of the corresponding site is increased and cracks occur during continuous deformation.

The relation represented by the following Equation 1 satisfies between one grain orientation g1 and another grain orientation g2 adjacent thereto in an EBSD GB map.

$$g1=12*g2 \quad \text{(Equation 1)}$$

(wherein R is a rotation matrix required for rotation of the orientation g2 with respect to the orientation g1.)

Rotation matrix R is represented by one rotation axis [r1, r2, r3] and a rotation angle ω, and the difference in orientation between the orientation g1 and the orientation g2 is represented by each g. In addition, orientation difference g of the grain boundary is present. In general, a grain boundary having g of 15 degrees or more is referred to as a high angle grain boundary, and a grain boundary having g of less than 15 degrees is referred to as a low angle grain boundary. An area ratio between g of 15 degrees or more and g of less than 15 degrees is measured from measurement results of EBSD.

In order to improve all of tensile strength, spring limit, bendability and electric conductivity of the copper alloy material, there is a need to evenly form balance among {001}, {110} and {112} crystal planes of the copper alloy material as well as balance between low angle grain boundary and high angle grain boundary among the grain boundaries.

In order to secure bendability, the copper alloy material according to the present invention has a {001} crystal plane fraction of 10% or less, more preferably 2 to 7%. When the {001} crystal plane fraction is higher than 10%, {001} crystal plane is formed during thermal treatment such as solution heat treatment or precipitation heat treatment, bendability is increased, but {110} and {112} planes are relatively decreased, thus causing deterioration in tensile strength and spring limit.

In addition, in order to improve tensile strength and spring limit of the copper alloy material according to the present invention, preferably, the {110} crystal plane fraction is 30 to 60% and the {112} crystal plane fraction is 30 to 60%, and more preferably, the {110} crystal plane fraction is 35 to 50% and the {112} crystal plane fraction is 35 to 50%. When the fractions of {110} and {112} crystal planes are 60% or higher, tensile strength and spring limit are good, but cracks occur during bending work due to rapid formation of dislocation density and, when fractions of {110} and {112} crystal planes are 30% or less, bendability is good, but precipitations are not sufficiently formed due to low fraction of dislocation density, and tensile strength and spring limit are thus deteriorated.

In addition, the fraction of low angle grain boundary is preferably 50 to 70%, more preferably, 60 to 70%. When the fraction of low angle grain boundary is 50% or less, dislocation density at the grain boundary is increased due to excessively high fraction of high angle grain boundary and bendability is rapidly deteriorated. When the fraction of low angle grain boundary fraction is 70% or higher, bendability is good, but tensile strength and spring limit cannot be sufficiently secured.

Accordingly, as described above, regarding the copper alloy material according to the present invention, the fraction of the {001} crystal plane is adjusted to 10% or less, the fraction of the {110} crystal plane is adjusted to 30 to 60%, and the fraction of the {112} crystal plane is adjusted to 30 to 60%, thereby making the balance between {001}, {110} and {112} crystal planes, and the fraction of the low angle grain boundary is adjusted to 50 to 70% so that low angle grain boundary and high angle grain boundary can be kept in balance, and bendability, tensile strength and spring limit of the finally obtained copper alloy material are thus good.

Example 1

Preparation of Copper Alloy Material Sample (Example and Comparative Example)

Constituent elements were mixed based on the composition set forth in Table 2 and were subjected to dissolution using a high frequency induction furnace and ingot casting. The ingot had a weight of 5 kg, a thickness of 30 mm, a width of 100 mm and a length of 150 mm. The copper alloy ingot was hot rolled at 980° C. to produce a plate and cooled in water and opposite surfaces thereof were face-cut to a thickness of 0.5 mm in order to remove oxide scale. Then, the ingot was subjected to cold work by cold rolling to a thickness of 0.4 mm and was sequentially subjected to solution heat treatment, cold rolling, precipitation heat treatment and stress relief treatment according to conditions set forth in Table 3. The resulting samples are numbered as Example and Comparative Example, as set forth in Table 2.

TABLE 2

| | Chemical composition | | | | |
|---|---|---|---|---|---|
| No. | Cu | Ni | Si | Sn | Others |
| Example 1 | Rem | 1.8 | 0.3 | 0.3 | 0.01P |
| Example 2 | Rem | 1.8 | 0.3 | 0.3 | |
| Example 3 | Rem | 2.0 | 0.5 | 0.3 | 0.1Ti + 0.1Co |
| Example 4 | Rem | 2.2 | 0.5 | 0.3 | 0.01P + 0.1Zn |
| Example 5 | Rem | 2.2 | 0.5 | 0.2 | 0.1Mn + 0.1Cr |
| Example 6 | Rem | 2.2 | 0.5 | 0.2 | |
| Example 7 | Rem | 2.2 | 0.5 | 0.3 | |
| Example 8 | Rem | 2.9 | 0.7 | 0.3 | 0.01P |
| Example 9 | Rem | 2.9 | 0.7 | 0.3 | |
| Example 10 | Rem | 2.9 | 0.7 | 0.3 | |
| Example 11 | Rem | 3.5 | 0.8 | 0.3 | 0.01P |
| Example 12 | Rem | 3.5 | 0.8 | 0.3 | 0.01Ti |
| Example 13 | Rem | 3.4 | 0.8 | 0.2 | |
| Comparative Example 1 | Rem | 0.7 | 0.2 | 0.4 | |
| Comparative Example 2 | Rem | 1.8 | 0.3 | 0.3 | 0.01P |
| Comparative Example 3 | Rem | 2.2 | 0.3 | 0.3 | 0.01P + 0.1Zn |
| Comparative Example 4 | Rem | 2.9 | 0.6 | 0.3 | |
| Comparative Example 5 | Rem | 1.8 | 0.3 | 0.3 | 0.01P |
| Comparative Example 6 | Rem | 4.5 | 0.8 | 0.3 | |
| Comparative Example 7 | Rem | 1.8 | 0.3 | 0.3 | |
| Comparative Example 8 | Rem | 2.9 | 0.7 | 0.3 | |
| Comparative Example 9 | Rem | 1.8 | 0.4 | 0.3 | 0.01P + 0.1Zn |
| Comparative Example 10 | Rem | 2.2 | 0.5 | 0.3 | 0.01P + 0.1Zn |

TABLE 3

| | Process | | | | | | | | | |
|---|---|---|---|---|---|---|---|---|---|---|
| | Solution heat treatment | | | | Final rolling | | Precipitation heat treatment | | Stress relief | |
| No. | Conditions (° C.) | Time (sec) | Hardness (Hv) | Particle size (μm) | Rolling reduction (%) | Number of rolling (number of passes) | Temperature (° C.) | Time (Hr) | Temperature (° C.) | Speed (sec) |
| Example 1 | 950 | 25 | 79 | 8 | 40 | 3 | 460 | 4 | 600 | 20 |
| Example 2 | 950 | 25 | 85 | 5 | 20 | 3 | 460 | 4 | 600 | 20 |
| Example 3 | 950 | 25 | 86 | 4 | 40 | 3 | 460 | 4 | 600 | 20 |
| Example 4 | 950 | 25 | 85 | 12 | 40 | 3 | 460 | 4 | 600 | 20 |
| Example 5 | 950 | 25 | 83 | 15 | 40 | 3 | 460 | 4 | 600 | 20 |
| Example 6 | 950 | 25 | 82 | 12 | 40 | 3 | 460 | 4 | 600 | 20 |
| Example 7 | 950 | 25 | 85 | 13 | 20 | 3 | 460 | 4 | 600 | 20 |
| Example 8 | 950 | 25 | 87 | 11 | 20 | 3 | 460 | 4 | 600 | 20 |
| Example 9 | 950 | 25 | 89 | 13 | 15 | 3 | 460 | 4 | 600 | 20 |
| Example 10 | 950 | 25 | 85 | 7 | 20 | 3 | 460 | 4 | 600 | 20 |
| Example 11 | 950 | 25 | 92 | 11 | 20 | 3 | 460 | 4 | 600 | 20 |
| Example 12 | 950 | 25 | 91 | 12 | 20 | 3 | 460 | 4 | 600 | 20 |
| Example 13 | 950 | 25 | 95 | 10 | 15 | 3 | 460 | 4 | 600 | 20 |
| Comparative Example 1 | 950 | 25 | 92 | 12 | 40 | 3 | 460 | 4 | 550 | 20 |
| Comparative Example 2 | 700 | 0.5 | 130 | 1 | 40 | 3 | 460 | 4 | 550 | 20 |
| Comparative Example 3 | 1050 | 400 | 62 | 50 | 40 | 3 | 440 | 4 | 550 | 20 |
| Comparative Example 4 | 950 | 25 | 91 | 9 | 80 | 3 | 480 | 4 | 550 | 20 |
| Comparative Example 5 | 950 | 25 | 85 | 10 | 5 | 3 | 440 | 4 | 550 | 20 |
| Comparative Example 6 | Cracked during hot rolling | | | | | | | | | |
| Comparative Example 7 | 950 | 25 | 82 | 11 | 40 | 3 | 700 | 25 | 600 | 20 |
| Comparative Example 8 | 950 | 25 | 81 | 12 | 20 | 3 | 300 | 1 | 600 | 20 |
| Comparative Example 9 | 950 | 25 | 82 | 9 | 40 | 3 | 460 | 4 | 800 | 4000 |
| Comparative Example 10 | 950 | 25 | 85 | 4 | 40 | 3 | 460 | 4 | 200 | 5 |

The copper alloys of Example and Comparative Example obtained in accordance with Tables 2 and 3 were produced into 0.25 mm copper alloy plate samples, and tensile strength, spring limit, bendability, electrical conductivity, crystal plane, and fraction of low angle grain boundary among grain boundaries of the samples were measured in accordance with the following method.

Test Example (Measurement of Crystal Plane and Grain Boundary)

Final samples were subjected to mechanical polishing and electrolytic polishing to 0.05 μm and were then subjected to EBSD measurement of FE-SEM and analysis using a TSL OIM analyzer. The grain area ratios were obtained from {001}, {110} and {112} crystal plane fractions obtained by calculation of (x,y) orientations of coordinates from results of EBSD test. In addition, fractions of low angle grain boundary and high angle grain boundary were calculated from the value g of the grain boundary.

As described above, measurement results of crystal plane and grain boundary fractions of copper alloy material samples produced in accordance with Examples 1 and 4 are shown in FIGS. 1 and 2. Specifically, FIG. 1A shows a crystal plane fraction of a copper alloy material (Cu-1.8Ni-0.3Si-0.3Sn-0.01P) according to Example 1 and FIG. 1B shows a grain boundary fraction of the copper alloy material. In addition, FIG. 2A shows a crystal plane fraction of a copper alloy material (Cu-2.2Ni-0.5Si-0.3Sn-0.01P-0.1Zn) according to Example 4, and FIG. 2B shows a grain boundary fraction of the copper alloy material. In FIGS. 1A and 1B, the fraction of {001} crystal plane is 4.3%, the fraction of {110} crystal plane is 36.0%, the fraction of {112} crystal plane is 45.0%, the fraction of low angle grain boundary is 65.4% and the fraction of high angle grain boundary is 35.7%. In this regard, as can be seen from Table 5, the copper alloy material according to Example 1 has a tensile strength of 654 MPa, electrical conductivity of 44% IACS, a spring limit of 502 MPa, and excellent bendability in a rolling direction and a direction vertical to rolling.

In FIGS. 2A and 2B, the fraction of {001} crystal plane is 3.5%, the fraction of {110} crystal plane is 40.4%, and the fraction of {112} crystal plane is 41.2%, the fraction of low angle grain boundary is 64.3%, and the fraction of high angle grain boundary is 35.7%. In addition, as can be seen from the following Table 5, the copper alloy material according to Example 4 has a tensile strength of 742 MPa, electrical conductivity of 41% IACS, spring limit of 547 MPa, and superior bendability in both a rolling direction and a direction vertical to rolling.

TABLE 4

| No. | Crystal plane {001} | Crystal plane {110} | Crystal plane {112} | Grain boundary Low angle grain boundary (2-15) | Grain boundary High angle grain boundary (15-180) |
|---|---|---|---|---|---|
| Example 1 | 4.3 | 36.0 | 45.0 | 65.4 | 34.6 |
| Example 2 | 4.4 | 37.8 | 44.9 | 64.9 | 35.1 |
| Example 3 | 3.9 | 40.3 | 42.8 | 62.8 | 37.2 |
| Example 4 | 3.5 | 40.4 | 41.2 | 64.3 | 35.7 |
| Example 5 | 3.8 | 42.3 | 43.1 | 65.9 | 34.1 |
| Example 6 | 3.9 | 39.8 | 42.1 | 62.8 | 37.2 |
| Example 7 | 4.2 | 42.5 | 43.1 | 66.8 | 33.2 |
| Example 8 | 3.6 | 35.4 | 44.3 | 68.3 | 31.7 |
| Example 9 | 3.8 | 38.2 | 45.2 | 69.5 | 30.5 |
| Example 10 | 3.2 | 39.4 | 44.2 | 67.8 | 32.2 |
| Example 11 | 3.1 | 32.5 | 47.1 | 67.1 | 32.9 |
| Example 12 | 3.5 | 33.5 | 48.1 | 69.0 | 31.0 |
| Example 13 | 3.0 | 32.5 | 48.5 | 68.5 | 31.5 |
| Comparative Example 1 | 6.5 | 42.5 | 43.2 | 67.5 | 32.5 |
| Comparative Example 2 | 1.3 | 33.1 | 37.5 | 63.4 | 36.6 |
| Comparative Example 3 | 8.3 | 38.5 | 44.2 | 57.9 | 42.1 |
| Comparative Example 4 | 2.5 | 52.9 | 53.2 | 45.8 | 54.2 |
| Comparative Example 5 | 14.3 | 25.9 | 22.3 | 75.5 | 24.5 |
| Comparative Example 6 | — | — | — | — | — |
| Comparative Example 7 | 15.3 | 35.2 | 37.6 | 68.9 | 31.1 |
| Comparative Example 8 | 2.5 | 45.2 | 49.2 | 50.2 | 49.8 |
| Comparative Example 9 | 6.1 | 38.1 | 44.6 | 68.1 | 31.9 |
| Comparative Example 10 | 3.8 | 39.5 | 43.6 | 64.3 | 35.7 |

(Tensile Strength)

Tensile strength was measured in a rolling direction using a tensile strength tester in accordance with JIS Z 2241. The unit of tensile strength is MPa.

(Electrical Conductivity)

Electric resistance was measured at 240 Hz using a 4-probe method, and resistance and electrical conductivity were represented as percentage (% IACS) based on standard reference sample pure copper.

(Spring Limit)

Spring limit was measured in accordance with JIS H3130. In accordance with a cantilever-type measurement method according to specification, permanent deformation was measured by fixing one end of a plate while stepwise increasing bending variation at the other end thereof. Spring limit was calculated using force at the measured permanent deformation. The unit is MPa.

(Bendability)

Bending test was conducted in a good way direction (bending in a direction vertical to a rolling direction) and in a bad way direction (bending in a direction parallel to a rolling direction) under the conditions of an inner bending radius R and a material thickness t. After completely contacting at 180 degrees under R/t=0 conditions (in which R=flexural radius, t=thickness of a material), cracks are observed with an optical microscope. The case in which fine cracks do not occur is represented by "0" and the case in which fine cracks occur is represented by "X".

The measurement values are shown in the following Table 5.

TABLE 5

| No | Physical properties of finished product: Tensile strength (MPa) | Electric conductivity (% IACS) | Spring limit (MPa) | Bendability: Good way (direction vertical to rolling) | Bendability: Bad way (direction parallel to rolling) |
|---|---|---|---|---|---|
| Example 1 | 654 | 44 | 502 | ○ | ○ |
| Example 2 | 645 | 43 | 498 | ○ | ○ |
| Example 3 | 693 | 41 | 512 | ○ | ○ |
| Example 4 | 742 | 41 | 547 | ○ | ○ |
| Example 5 | 745 | 42 | 557 | ○ | ○ |
| Example 6 | 738 | 43 | 543 | ○ | ○ |
| Example 7 | 748 | 39 | 549 | ○ | ○ |
| Example 8 | 794 | 37 | 665 | ○ | ○ |
| Example 9 | 782 | 39 | 656 | ○ | ○ |
| Example 10 | 789 | 38 | 652 | ○ | ○ |
| Example 11 | 958 | 36 | 727 | ○ | ○ |
| Example 12 | 953 | 35 | 712 | ○ | ○ |
| Example 13 | 942 | 35 | 723 | ○ | ○ |
| Comparative Example 1 | 558 | 52 | 406 | ○ | ○ |
| Comparative Example 2 | 562 | 42 | 443 | ○ | x |
| Comparative Example 3 | 752 | 40 | 453 | ○ | x |
| Comparative Example 4 | 823 | 39 | 616 | x | x |
| Comparative Example 5 | 598 | 42 | 433 | ○ | ○ |
| Comparative Example 6 | — | — | — | — | — |
| Comparative Example 7 | 521 | 48 | 370 | ○ | ○ |
| Comparative Example 8 | 432 | 28 | 432 | x | x |
| Comparative Example 9 | 592 | 44 | 405 | ○ | ○ |
| Comparative Example 10 | 741 | 41 | 378 | ○ | ○ |

As can be seen from results of Examples set forth in Tables 4 and 5, as a result of solution heat treatment using chemical components, final rolling, aging treatment and stress relief treatment, the fraction of the {001} crystal plane is 10% or less, the fraction of the {110} crystal plane is 30 to 60%, the fraction of the {112} crystal plane is 30 to 60%, low angle grain boundary fraction of grain boundary is 50 to 70%, tensile strength is 620 to 1,000 MPa, spring limit is 460 to 750 MPa and cracks do not occur during bending work in a rolling direction (also referred to as direction parallel to rolling) and in a direction vertical to rolling.

Comparative Example 1, which includes Ni in an amount of less than 1 wt %, had good bendability due to insufficient amounts of Ni and Si precipitates, but had poor tensile strength and spring limit. Comparative Example 2, which was subjected to solution heat treatment at a temperature of 700° C. for 0.5 seconds, did not form an over-saturated solution due to supply of insufficient amount of heat. As a result, the sample of Comparative Example 2 did not secure sufficient tensile strength and spring limit even under the conditions of optimal precipitation heat treatment conditions. Comparative Example 3, which was subjected to solution heat treatment at 1,050° C. for 400 seconds, had poor bendability of the finally produced sample in the rolling direction due to rapid growth of grains in the copper alloy during solution heat treatment. Comparative Example 4, which was subjected to final rolling of 80%, exhibited a rapid increase in fractions of {110} and {112} crystal planes of the obtained sample, a decrease in fraction of the low angle grain boundary, an increase in fraction of high angle grain boundary and deterioration in bendability both in a rolling direction and in a direction vertical to rolling. Comparative Example 5, which was subjected to final cold rolling at a rolling ratio of 5%, could not secure sufficient tensile strength and spring limit due to excessively low fractions of {110} and {112} crystal planes of the obtained sample. Comparative Example 6, which contains 4.5 wt % of Ni, suffered from side cracking during hot rolling in the production of the copper alloy material. This was found to be due to over-growth of Ni—Si crystals during casting and hot work. Comparative Example 7, which was subjected to precipitation heat treatment at 700° C. for 25 hours, had good bendability of the sample obtained in the over-aging area, but had significantly reduced tensile strength and spring limit. Comparative Example 8, which was subjected to precipitation heat treatment at 300° C. for 1 hour, had poor electrical conductivity, tensile strength and spring limit due to incomplete growth of Ni—Si precipitates in the copper alloy sample. Comparative Example 9, which was subjected to stress relief treatment at 800° C. for 4,000 seconds, had poor tensile strength and spring limit of the finally produced copper alloy material. This is because physical properties are deteriorated after tensile strength and spring limit reach maximum physical property ranges. Comparative Example 10, which was subjected to stress relief treatment at 200° C. for 5 seconds, could not sufficiently reduce stress present in the finally produced copper alloy material, when the treatment temperature was lower than that of the production method of the present invention, and did not sufficiently recover spring limit.

Based on high-temperature solution heat treatment, the copper alloy material produced in accordance with the production method of the present invention has a {001} crystal plane fraction of 10% or less, {110} and {112} crystal plane fractions, respectively, of 30 to 60%, and a low angle grain boundary fraction of 50 to 70%, and has improved tensile strength, spring limit, bendability and electrical conductivity. This material is very suitable for connectors and electric and electronic components which are advanced toward the trend of low weight, small size and high density.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A method of producing a copper alloy material for automobile and electrical and electronic components comprising:

(a) melting constituent components and casting an ingot from the constituent components, wherein the constituent components comprises 1.0 to 4.0 wt % of nickel (Ni), 0.1 to 1.0 wt % of silicon (Si), 0.1 to 1.0 wt % of tin (Sn), the balance of copper and an inevitable impurity, wherein the inevitable impurity comprises one or more transition metals selected from the group consisting of Ti, Co, Fe, Mn, Cr, Nb, V, Zr and Hf and is present in a total amount of 1 wt % or less;

(b) subjecting the resulting ingot to hot-rolling at a temperature of 750 to 1,000° C. for 1 to 5 hours;

(c) subjecting the resulting product to intermediate cold rolling at a rolling reduction of 50% or higher;

(d) subjecting the resulting product to high-temperature high-speed solution heat treatment at 780 to 1,000° C. for 1 to 300 seconds;

(e) subjecting the resulting product to final cold rolling at a total rolling reduction of 10 to 60% with the total rolling reduction being achieved with ten or less rolling passes;

(f) subjecting the product obtained by the previous step to precipitation heat treatment at 400 to 600° C. for 1 to 20 hours; and (g) subjecting the precipitation-treated product to stress relief treatment at 300 to 700° C. for 10 to 3,000 seconds, wherein, as a result of EBSD analysis, the obtained copper alloy material has a {001} crystal plane fraction of 10% or less, a {110} crystal plane fraction of 30 to 60%, a {112} crystal plane fraction of 30 to 60%, a low angle grain boundary fraction of 50 to 70%, tensile strength of 620 to 1,000 MPa, spring limit of 460 to 750 MPa, electrical conductivity of 35 to 50% IACS, and superior bendability in a rolling direction and a direction vertical to the rolling direction.

2. The method according to claim 1, wherein (c) intermediate rolling and (d) solution heat treatment are repeatedly conducted, according to the necessity.

3. The method according to claim 1, further comprising adjusting a plate shape, before or after (f) precipitation heat treatment.

4. The method according to claim 1, further comprising plating tin (Sn), silver (Ag), or nickel (Ni) after (g) stress relief.

5. The method according to claim 1, further comprising producing the copper alloy material obtained after (g) stress relief in the form of a plate, rod or tube.

6. The method according to claim 1, wherein 1.0 wt % or less of phosphorous (P) is further added.

7. The method according to claim 1, wherein 1.0 wt % or less of zinc (Zn) is further added.

8. The method according to claim 1, wherein 1.0 wt % or less of phosphorous (P) and 1.0 wt % or less of zinc (Zn) are further added.

* * * * *